US008098268B2

(12) United States Patent
Kariya et al.

(10) Patent No.: US 8,098,268 B2
(45) Date of Patent: Jan. 17, 2012

(54) THERMAL HEAD AND PRINTING DEVICE

(75) Inventors: Izumi Kariya, Kanagawa (JP); Noboru Koyama, Tokyo (JP); Mitsuo Yanase, Kanagawa (JP); Tooru Morikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1076 days.

(21) Appl. No.: 11/686,595

(22) Filed: Mar. 15, 2007

(65) Prior Publication Data

US 2008/0106588 A1 May 8, 2008

(30) Foreign Application Priority Data

Mar. 17, 2006 (JP) ..... P2006-075633

(51) Int. Cl.
*B41J 2/34* (2006.01)

(52) U.S. Cl. ..... 347/206; 347/205; 347/204

(58) Field of Classification Search ..... 347/208, 347/204–206

See application file for complete search history.

(56) References Cited

U.S. PATENT DOCUMENTS

| | | | | |
|---|---|---|---|---|
| 5,229,789 | A * | 7/1993 | Kishida et al. | 347/209 |
| 2009/0262176 | A1* | 10/2009 | Shoji et al. | 347/206 |
| 2010/0118105 | A1* | 5/2010 | Morooka et al. | 347/206 |

FOREIGN PATENT DOCUMENTS

| | | |
|---|---|---|
| EP | 0 433 865 A2 | 6/1991 |
| EP | 1 077 135 A1 | 2/2001 |
| EP | 1 403 075 A1 | 3/2004 |
| FR | 2.222.845 | 10/1974 |
| JP | 61-196039 | 12/1986 |
| JP | 01-110165 | 4/1989 |
| JP | 08-216443 | 8/1996 |
| JP | 08216443 | 8/1996 |
| JP | 09-174905 | 7/1997 |
| JP | 2003-266751 | 9/2003 |
| JP | 2006-035836 | 2/2006 |

OTHER PUBLICATIONS

European Search Report in counterpart EP Application No. 07005478.8-2304 dated Sep. 20, 2007.
Japanese Patent Office Action corresponding to Japanese Serial No. 2006-075633 dated Mar. 2, 2010.
Japanese Office Action issued on Jun. 15, 2010 in connection with counterpart JP Appl. No. 2006-075633.

* cited by examiner

*Primary Examiner* — Stephen Meier
*Assistant Examiner* — Sarah Al Hashimi
(74) *Attorney, Agent, or Firm* — SNR Denton US LLP

(57) ABSTRACT

A thermal head includes a glass layer provided with a groove section formed inside the glass layer, a heat generating resistor disposed outside the glass layer, and a pair of electrodes provided to both sides of the heat generating resistor, wherein a part of the heat generating resistor exposed between the pair of electrodes is defined as a heat generating section, and at least one of the pair of electrodes has a smaller width in an end section on an opposite side to a side of the heat generating section than a width of an end section on the side of the heat generating section.

8 Claims, 8 Drawing Sheets

THERMAL HEAD AND PRINTING DEVICE

CROSS REFERENCES TO RELATED APPLICATIONS

The present invention contains subject matters related to Japanese Patent Applications JP 2006-075633 filed in the Japan Patent Office on Mar. 17, 2006, the entire contents of which being incorporated herein by reference.

BACKGROUND OF THE INVENTION

1. Field of the Invention

The present invention relates to a thermal head and a printing device for thermal-transferring a color material on an ink ribbon to a print medium.

2. Description of the Related Art

As a printing device for printing images or characters on a print medium, there is a thermal transfer printing device (hereinafter simply referred to as a printing device) which sublimates a color material forming a ink layer provided to one surface of an ink ribbon to thermal-transfer the color material to a print medium, thereby printing color images or characters. The printing device is provided with a thermal head for thermal-transferring the color material on the ink ribbon to the print medium and a platen disposed at a position facing the thermal head and for supporting the ink ribbon and the print medium.

In the printing device, the ink ribbon and the print medium are overlapped so that the ink ribbon faces the thermal head and the print medium faces the platen, and the ink ribbon and the print medium run between the thermal head and the platen while the platen presses the ink ribbon and the print medium against the thermal head. In this case, the printing device applies thermal energy to the ink ribbon running between the thermal head and the platen with the thermal head on the ink layer from the rear face side of the ink ribbon, and sublimates the color material with the thermal energy to thermal-transfer the color material to the print medium, thereby printing color images or characters.

In this thermal transfer printing device, power consumption becomes larger when printing at higher speed because the thermal head needs to be rapidly heated to a high temperature. Therefore, it is difficult particularly in home-use printing devices to increase printing speeds while achieving lower power consumption. In order for achieving high speed printing by a home-use thermal transfer printing device, it is required to improve the thermal efficiency of the thermal head to reduce power consumption.

As a thermal head for a thermal transfer printing device used from the past, for example, a thermal head 100 shown in FIG. 9 can be cited. The thermal head 100 is composed of a glass layer 102 formed on a ceramic substrate 101, and a heat generating resistor 103, a pair of electrodes 104*a*, 104*b* for making the heat generating resistor 103 generate heat, a protective layer 105 for protecting the heat generating resistor 103 and the electrodes 104*a*, 104*b* sequentially formed on the glass layer 102. In the thermal head 100, a part of the heat generating resistor 103 exposed from a gap between the pair of electrodes 104*a*, 104*b* forms a heat generating section 103*a* for generating heat. The glass layer 102 is formed to have a substantially circular arc shape in order for making the heat generating section 103*a* face the ink ribbon and the print medium.

Since the ceramic substrate 101 having high thermal conductivity is used in the thermal head 100, the thermal energy generated from the heat generating section 103*a* is radiated from the glass layer 102 through the ceramic substrate 101 to rapidly lower the temperature, thus offering a preferable response. However, in the thermal head 100, since the thermal energy in the heat generation section 103*a* is radiated to the side of the ceramic substrate 101 to easily reduce the temperature, the power consumption for raising the temperature to the sublimation point increases, thus making the thermal efficiency worse. According to the thermal head 100, although the preferable response can be obtained, thermal efficiency is degraded, and accordingly, it is required to heat the heat generating section 103*a* for a long period of time to obtain a desired depth, which causes large power consumption and makes it difficult to improve the printing speed while achieving low power consumption.

In order for solving such a problem, the inventors of the present invention invented a thermal head 110 as shown in FIG. 10. This thermal head will be explained below as related art of the present invention, in which the thermal head 110 uses a glass layer 111 having lower thermal conductivity than the ceramic substrate instead of the ceramic substrate in order for preventing the thermal energy in thermal-transferring the color material to the print medium from being conducted to the substrate side. The thermal head 110 is composed of a heat generating resistor 112, a pair of electrodes 113*a*, 113*b* and a protective layer 114 sequentially formed on the glass layer 111 provided with a protruding section 111*a* having a substantially circular arc shape. The protruding section 111*a* of the glass layer 111 is formed like a substantially circular arc in order for making a heat generating section 112*a* of the heat generating register 112, which is exposed from a gap between the pair of electrodes 113*a*, 113*b*, and generating heat, face the ink ribbon and the print medium.

In the thermal head 110, since the glass layer 111 having lower thermal conductivity than the ceramic substrate 101 shown in FIG. 9 serves as the ceramic substrate 101, it becomes difficult for the thermal energy generated from the heat generating section 112*a* to be radiated to the side of the glass layer 111. Thus, in the thermal head 110, the quantity of the heat conducted to the ink ribbon side can be increased, thus the temperature thereof can rapidly be raised in thermal-transferring the color material to the print medium. Therefore, it becomes possible to reduce power consumption for raising the temperature to the sublimation temperature, thus making the thermal efficiency more preferable. However, in the thermal head 110, it becomes difficult for the thermal energy stored in the glass layer 111 to be radiated, thus the temperature of the thermal head 110 does not drop immediately because of the thermal energy stored in the glass layer 111, which degrades the response in contrast to the case with the thermal head 100. Thus, in the thermal head 110, since the response is degraded even with the improved thermal efficiency, it is difficult to increase the printing speed.

Since it is required to improve both of the thermal efficiency, which is a downside of the thermal head 100, and the response, which is a downside of the thermal head 110, for achieving high speed printing of high quality images or characters with reduced power consumption in thermal transfer printing devices, the inventors of the present invention further invented a thermal head 120 as shown in FIG. 11. This thermal head will be explained below as further related art of the present invention, in which the thermal head 120 is composed of a heat generating resistor 122, a pair of electrodes 123*a*, 123*b*, a protective layer 124 sequentially formed on the glass layer 121 having a protruding section 121*a* formed like a substantially circular arc in order for making a heat generating section 122*a* of the heat generating register 122, which is exposed from a gap between the pair of electrodes 123*a*,

123*b*, face the ink ribbon and the print medium, and inside the glass layer 121, there is formed a groove section 125 filled with air.

In the thermal head 120, by providing a groove section 125 to the glass layer 121, the thermal conductivity of the groove section 125 is lowered because of the nature of air of having lower thermal conductivity than glass, thus the heat radiation to the glass layer 121 side can further suppressed than in the case with the thermal head 100 shown in FIG. 9 using the ceramic substrate 101. Thus, in the thermal head 120, the amount of heat conducted to the ink ribbon side increases, and accordingly, the power consumption for raising the temperature to the sublimation temperature of the color material can be reduces when thermal-transferring the color material, thus making the thermal efficiency preferable. Further, in the thermal head 120, since the thickness of the glass layer 121 is made smaller to reduce the heat storage capacity of the glass layer 121 by providing the groove section 125 to the glass layer 121, the thermal energy stored in the glass layer 121 can be radiated in a shorter period of time than in the case with the thermal head 110 shown in FIG. 10 without the groove in the glass layer 111, thus rapidly lowering the temperature when the color material is not thermal-transferred, thus making the response preferable. According to these facts, in the thermal head 120, both of the thermal efficiency and the response can be made preferable by providing the groove section 125 to the glass layer 121. In other words, the downsides of the thermal head 100 and the thermal head 110 described above can be improved at the same time in the thermal head 120.

However, although in the thermal head 120, the heat radiation to the side of the glass layer 121 can be prevented by providing the groove section 124 to the glass layer 121, the heat is problematically radiated from the electrodes 123*a*, 123*b* made of aluminum or the like having high thermal conductivity. Therefore, the thermal efficiency might be degraded in the thermal head 120. Since the heat is radiated from the electrodes 123*a*, 123*b* to reduce the amount of heat necessarily used for thermal-transferring the color material, thus degrading the thermal efficiency in the thermal head 120, it is difficult to print images and characters at high speed.

The above related art is described in JP-A-8-216443.

SUMMARY OF THE INVENTION

It is therefore desirable to provide a thermal head and a printing device capable of preventing the heat radiation from the electrode.

According to an embodiment of the present invention, there is provided a thermal head including a glass layer provided with a groove section formed inside the glass layer, a heat generating resistor disposed outside the glass layer, and a pair of electrodes provided to both sides of the heat generation resistor, wherein a part of each of the heat generation resistors exposed between the pair of electrodes is defined as a heat generation section, and at least one of the pair of electrodes has a smaller width in an end section on an opposite side to a side of the heat generating section than a width of an end section on the side of the heat generating section.

According to another embodiment of the present invention, there is provided a printing device including a thermal head having a glass layer provided with a groove section formed inside the glass layer, a heat generating resistor disposed outside the glass layer, and a pair of electrodes provided to both sides of the heat generation resistor, wherein a part of each of the heat generation resistors exposed between the pair of electrodes is defined as a heat generation section, and at least one of the pair of electrodes has a smaller width in an end section on an opposite side to a side of the heat generating section than a width of an end section on the side of the heat generating section.

According to the above embodiments of the invention, the width of the end section of the pair of electrodes on the opposite side to the side of the heat generating section is made smaller than the width of the end section thereof on the side of the heat generating section, thus increasing the thermal resistance of the pair of electrodes, thereby preventing the heat radiation and improving the thermal efficiency. According to the present invention, the thermal efficiency is improved, thus images and characters can be printed at high speed.

DESCRIPTION OF THE PREFERRED EMBODIMENTS

Hereinafter, a thermal transfer printing device implementing a thermal head applying an embodiment of the invention will be explained in detail with reference to the accompanying drawings.

Figure 1:
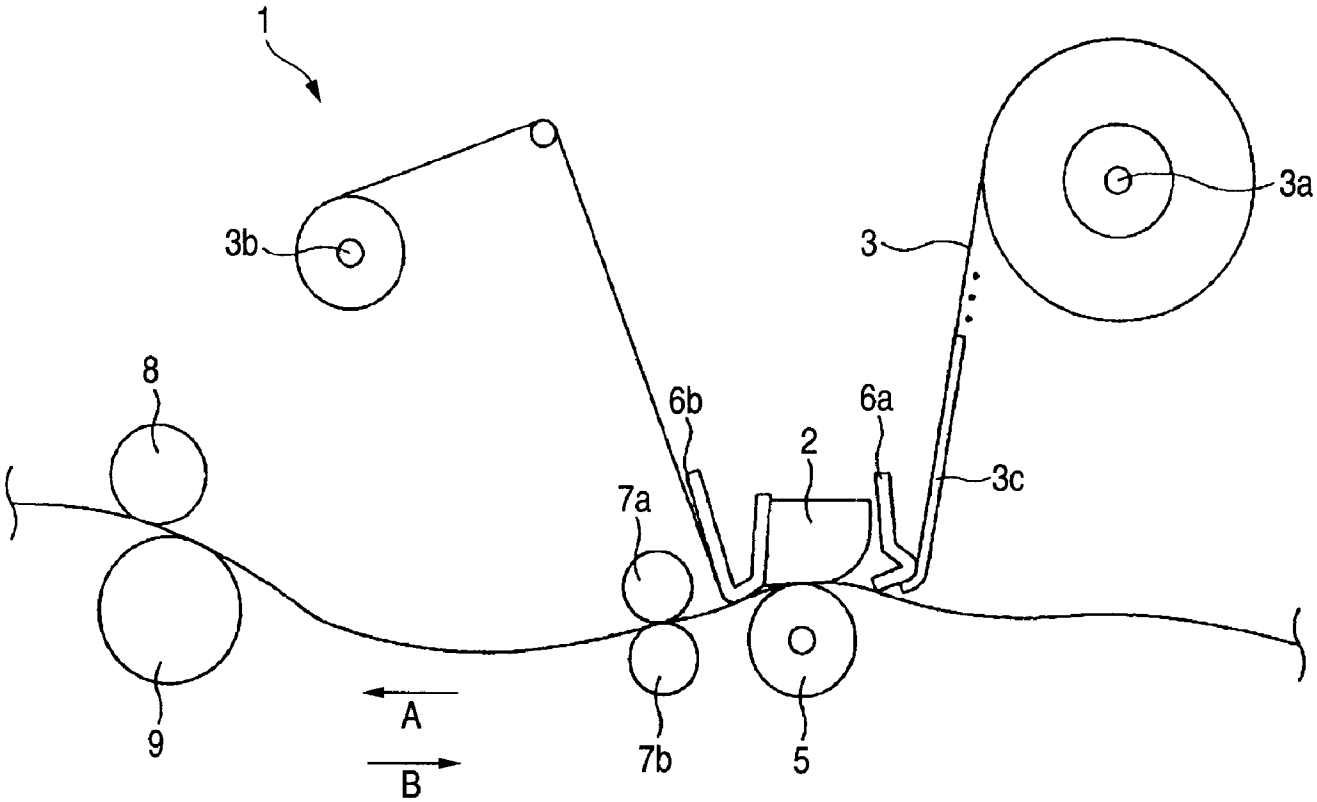
FIG. 1 is a schematic diagram showing a printing device provided with a thermal head applying an embodiment of the invention.

A thermal transfer printing device 1 (hereinafter referred to as a printing device 1) shown in FIG. 1 is a dye sublimation printer for sublimating a color material of an ink ribbon to thermal-transfer the color material to a print medium, and uses a thermal head 2 applying an embodiment of the invention as a recording head. The printing device 1 applies thermal energy generated by the thermal head 2 to the ink ribbon 3, thereby sublimating the color material of the ink ribbon 3 to thermal-transfer the color material of the ink ribbon 3 to the print medium 4, thus printing color images or characters. The printing device 1 is a home-use printing device, and is able to print on objects of, for example, a post card size as the print medium 4.

The ink ribbon 3 used here is formed of a long resin film, and is housed in an ink cartridge in a condition in which the part of the ink ribbon 3 not yet used in the thermal transfer process is wound around a supply spool 3*a* while the part of the ink ribbon 3 already used in the thermal transfer process is wound around a winding spool 3*b*. The ink ribbon 3 is provided with a transfer layer 3*c* repeatedly formed in a surface on one side of the long resin film, the transfer layer 3*c* being composed of an ink layer formed of a yellow color material, an ink layer formed of a magenta color material, an ink layer formed of a cyan color material, and a laminate layer formed of a laminate film to be thermal-transferred on the print medium 4 for improving stability of images or characters printed on the print medium 4.

In the printing device 1 having such a configuration, as shown in FIG. 1, the winding spool 3*b* is rotated in a winding direction to run the ink ribbon 3 in the winding direction, and the print medium 4 is pinched between the pinch roller 7*a* and the capstan roller 7*b* and fed in an ejection direction by rotating the capstan roller 7*b* and the ejection roller 8 in the ejection direction (the direction of arrow A in FIG. 1) between the thermal head 2 and the platen 5 while pressing the platen 5 against the thermal head 2. In a printing operation, the thermal energy is first applied to the yellow ink layer of the ink ribbon 3 from the thermal head 2 to thermal-transfer the yellow color material to the print medium 4 running while overlapping the ink ribbon 3. After thermal-transferring the yellow color material, in order for thermal-transferring the magenta color material to the image forming section on which images or characters are formed and the yellow color material has been thermal-transferred, the feed roller 9 is rotated towards the thermal head 2 (the direction of the arrow B in FIG. 1) to back-feed the print medium 4 towards the thermal head 2, thus making the leading end of the image forming section face the thermal head 2 and the magenta ink layer of the ink ribbon 3 face the thermal head 2. Then, similarly to the case of thermal-transferring the yellow ink layer, the thermal energy is also applied to the magenta ink layer to thermal-transfer the magenta color material to the image forming section of the print medium 4. Regarding the cyan color material and the laminate film, they are also thermal-transferred to the image forming section similarly to the case of thermal-transferring the magenta color material, thus color images or characters are printed by sequentially thermal-transferring the cyan color material and the laminate film to the print medium 4.

The thermal head 2 used for such a printing device 1 can print a framed image having margins on both edges in a direction perpendicular to the running direction of the print medium 4, namely the width direction of the print medium 4, and also a frameless image without the margins. The thermal head 2 has a size in a direction designated by the direction of the arrow L shown in FIG. 2 larger than the width of the print medium 4 so that the color material can be thermal-transferred to the both edges of the print medium 4 in the width direction thereof.

Figure 2:
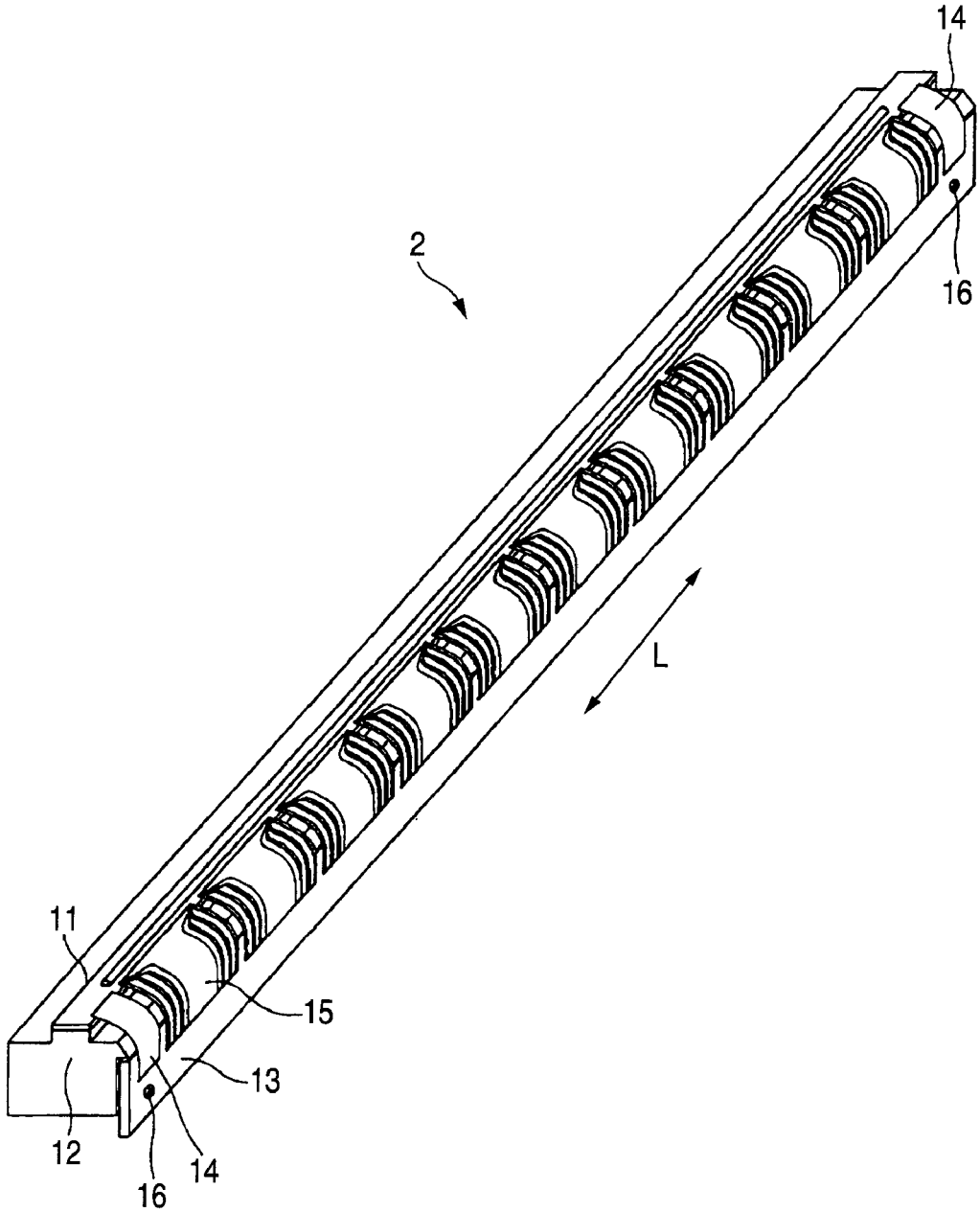
FIG. 2 is a perspective view of the thermal head.

As shown in FIG. 2, the thermal head 2 is provided with a head section 11 for applying thermal energy to the ink ribbon 3, a heat radiation member 12 for radiating the heat of the head section 11, a rigid board 13 provided with a control circuit for controlling driving of the head section 11, and a power supply flexible board 14 and a signal flexible board 15 each for electrically connecting the head section 11 and the rigid board 13 to each other.

Figure 3:
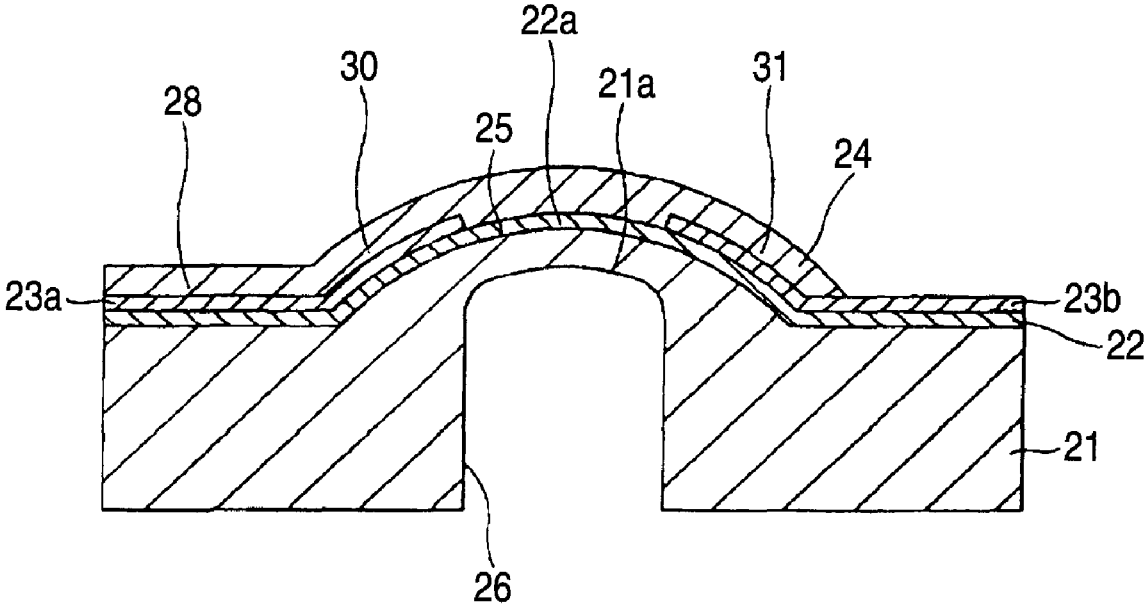
FIG. 3 is a cross-sectional view of the thermal head.

As shown in FIGS. 3, the head section 11 is provided with a glass layer 21, a heat generating resistor 22 disposed on the glass layer 21, a pair of electrodes 23*a*, 23*b* disposed on both sides of the heat generating resistor 22, and a resistor protective layer 24 disposed on and the periphery of the heat generating resistor 22. In the thermal head 2, a part of the heat generating resistor 22 exposed between the pair of electrodes 23*a*, 23*b* is defined as a heat generating section 22*a*. The glass layer 21 is provided with the heat generating resistor 22, the pair of electrodes 23*a*, 23*b*, and the resistor protective layer 24 formed on the upper surface thereof, and forms a base layer of the head section 11.

As shown in FIG. 3, the glass layer 21 is provided with a protruding section 25 in the outside surface thereof facing the ink ribbon 3, and is provided with a groove section 26 in the inside surface thereof to be bonded with the heat radiation member 12. The glass layer 21 is formed of glass having a softening point of, for example, 500° C. The glass layer 21 is provided with the protruding section 25 having a substantially circular arc shape on the outside surface thereof facing the ink ribbon 3, thus improving the contact condition with the ink ribbon 3 when the thermal head 2 heat the ink ribbon 3. Thus, the thermal head 2 becomes to appropriately apply the thermal energy from the heat generating section 22*a* with the protruding section 25.

In addition, it is sufficient that the glass layer 21 is made of a material having a predetermined surface property, a thermal characteristic, and so on represented by glass, and the concept of glass here includes synthetic gems or artificial stones such as synthetic quartz, synthetic ruby, or synthetic sapphire, or high-density ceramics.

The groove section 26 is disposed at a position opposed to the protruding section 25 in the inside surface of the glass layer 21, and formed concavely towards the side of the heat generating section 22*a*. The groove section 26 is formed along the length direction (the L direction in FIG. 2) of the thermal head 2.

Since the glass layer 21 having the configuration described above is provided with the groove section 26, the heat is not conducted to the whole body because of the characteristic of air having lower thermal conductivity than that of glass, thus the thermal energy generated by the heat generating section 22*a* can be prevented from being radiated. Further, in the glass layer 21, the stored thermal energy helps the color material be rapidly heated to the sublimation temperature with low power consumption when thermal-transferring the color material to the print medium 4. According to the above, since radiation of the thermal energy generated by the heat generating section 22*a* can be suppressed, and the color material can be rapidly heated to the sublimation temperature with low power consumption in the glass layer 21, the thermal efficiency of the thermal head 2 can be improved. Further, since the glass layer 21 is provided with the groove section 26, the thickness thereof becomes smaller to have a small heat storage capacity, and accordingly, the heat can easily be radiated, and when the heat generating section 22*a* does not generate heat, the temperature is rapidly lowered, thus improving the response of the thermal head 2. According to the above, both of the thermal efficiency and the response of the thermal head 2 can be made preferable with the glass layer 21 provided with the groove section 26. Thus, high quality images and characters can be printed at high speed with low power consumption without causing a problem such as a blur in the images using the thermal head 2 offering preferable response.

Figure 4:
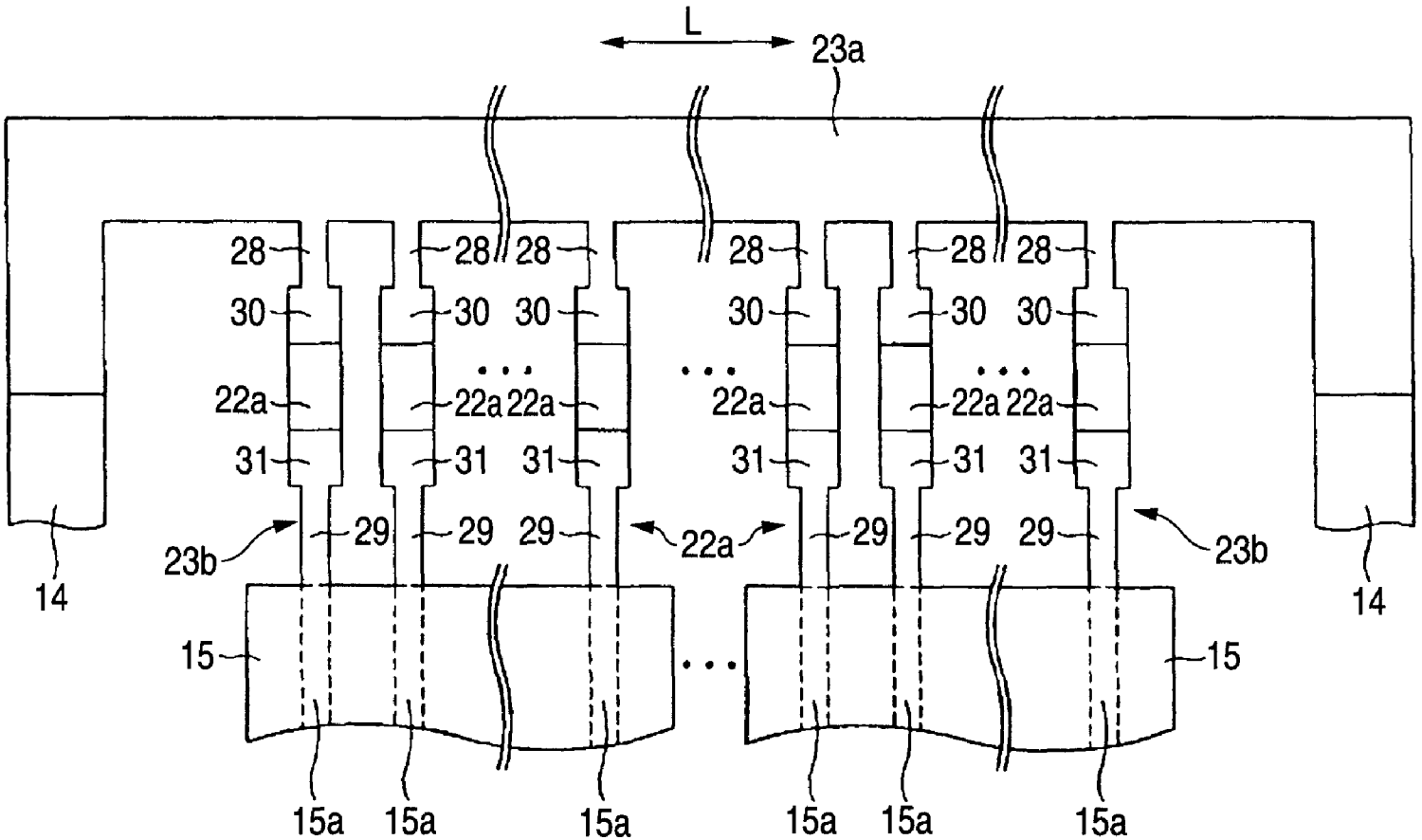
FIG. 4 is a plan view of the thermal head.

The heat generating resistor 22 provided on the glass layer 21 is disposed on the glass 21 so as to be shown in FIG. 3. The heat generating resistor 22 is made of a material having high electrical resistivity and heat resistance such as Ta—N or Ta—$SiO_2$. The heat generating resistor 22 generates heat at the heat generating section 22*a* exposed between the pair of electrodes 23*a*, 23*b*. As shown in FIG. 4, the heat generation sections 22*a* are arranged in parallel to each other and substantially linearly along the length direction (the L direction in FIG. 4) of the thermal head 2. The heat generation resistors 22 are patterned on the glass layer 21 by a photolithography technology.

The pair of electrodes 23*a*, 23*b* provided on both sides of each of the heat generation resistors 22 are disposed distantly from each other with the heat generating section 22*a* as shown in FIG. 4. The pair of electrodes 23*a*, 23*b* are made of a material having good electrical conductivity such as aluminum, gold, or copper. The pair of electrodes 23*a*, 23*b* are composed of a common electrode 23*a* electrically connected to all of the heat generation sections 22*a* and the individual electrode 23*b* electrically connected individually to each of the heat generation sections 22*a*.

The common electrode 23*a* electrically connects the power supply not shown to all of the heat generation sections 22*a* via the power supply flexible board 14 as shown in FIGS. 2 and 4, thus supplying electrical currents to the heat generation sections 22*a*. The common electrode 23*a* has a large area for providing connections with all of the heat generation sections 22*a*.

The individual electrode 23*b* is provided for each of the heat generation sections 22*a*, and electrically connected to the rigid board 13 provided with the control circuit for controlling driving of the heat generation sections 22*a* via the signal rigid board 15.

The common electrode 23*a* and the individual electrodes 23*b* apply the electrical currents to the heat generation sections 22*a* selected by the control circuit provided to the rigid board 13 and for controlling driving of the heat generation sections 22*a* to make the heat generation sections 22*a* generate heat.

Such a common electrode 23*a* and an individual electrode 23*b* are each made of a material with low resistivity such as aluminum, gold, or copper, and are each made to have a large contact area with the heat generating section 22*a* for efficiently applying the electrical currents to the heat generation sections 22*a*. In the common electrode 23*a* and the individual electrodes 23*b*, the thermal conductivity becomes higher to enhance radiation of the heat generated by the heat generating section 22*a* by reducing the resistivity and increasing the contact area with the heat generating section 22*a*. Therefore, in the common electrode 23*a* and the individual electrodes 23*b*, the width of end sections 28, 29 on the opposed side thereof to the side of the heat generating section 22*a* is arranged to be smaller than the width of the end sections 30, 31 on the side of the heat generating section 22*a* as shown in FIG. 4. In the common electrode 23*a*, by arranging the width of the end section 28 thereof on the opposed side to the side of the heat generating section 22*a* smaller than the width of the end section 30 on the side of the heat generating section 22*a*, the thermal energy generated by the heat generating section 22*a* can be prevented from being radiated to the power supply flexible board 14. In each of the individual electrodes 23*b*, by arranging the width of the end section 29 thereof on the opposed side to the side of the heat generating section 22*a* smaller than the width of the end section 31 on the side of the heat generating section 22*a*, the thermal energy generated by the heat generating section 22*a* can be prevented from being radiated to the signal flexible board 15. Further, in the common electrode 23*a* and the individual electrodes 23*b*, by arranging the width of the end sections 30, 31 thereof on the side of the heat generating section 22*a* substantially the same as the width of the heat generating section 22*a*, the contact area with the heat generating section 22*a* can be enlarged, thus supplying the electrical currents to the heat generating section 22*a*. It should be noted that in the head section 11, it is also possible to arrange only either one of the end sections 28, 29 of the electrodes 23*a*, 23*b* on the opposed side to the heat generating section 22*a* smaller.

Such a common electrode 23*a* and an individual electrode 23*b* are patterned by a photolithography method or the like.

It should be noted that in the head section 11, the heat generating resistors 22 are not necessarily required to be provided to the entire surface of the glass layer 21, but it is possible that the heat generating resistors 22 are disposed on parts of the protruding section 25, and the end portions of the common electrode 23*a* and the individual electrodes 23*b* are formed on the heat generating resistors 22.

The resistor protective layer 24 provided on the outermost side of the thermal head 2 covers the heat generating sections 22*a* and the peripheries of the heat generating sections 22*a* to protect the heat generating sections 22*a* and the electrodes 23*a*, 23*b* on the peripheries of the heat generating sections 22*a* from the friction and so on caused when the ink ribbon 3 comes in contact with the thermal head 2. The resistor protective layer 24 is made of a glass material containing metal and excel in mechanical characteristic such as high-strength and abrasion resistance under high temperature and in thermal characteristic such as heat resistance, thermal shock resistance, and thermal conductivity, such as SiAlON which includes silicon (Si) aluminum (Al), oxygen (O), and nitrogen (N).

Figure 5:
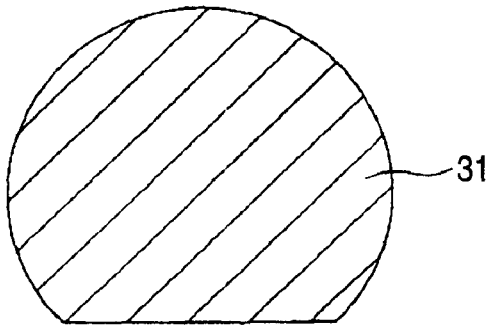
FIG. 5 is a cross-sectional view showing a glass material to be the material of the glass layer.
Figure 6:
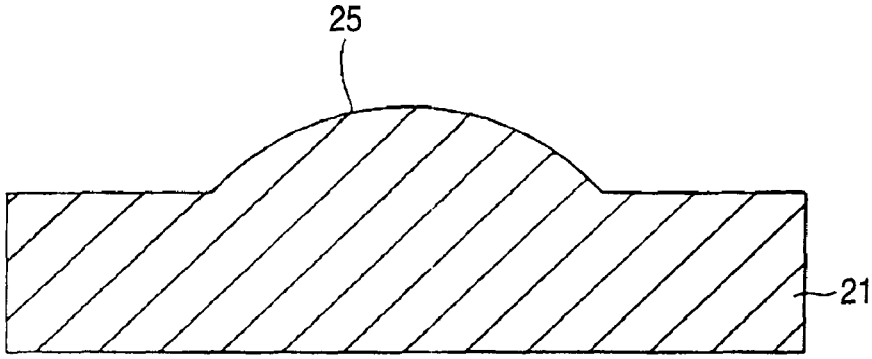
FIG. 6 is a cross-sectional view showing the glass layer.

The head section 11 as described above can be manufactured as described below. As an explanation regarding the method of manufacturing the head section 11, firstly, a glass material 31 to be used as the material of the glass layer 21 is prepared as shown in FIG. 5, and then as shown in FIG. 6, by performing a thermal press process, an etching process, or a cutting process on the glass material 31 to mold the glass layer 21 having the protruding section 25 on the upper surface thereof.

Subsequently, although not shown in detail, the resistor film to form the heat generating resistor 22 is formed on the surface of the glass layer 21 provided with the protruding section 25 with a material having high resistivity and heat resistance using a thin film forming technology such as sputtering, and further, a conductive film to form the pair of electrodes 23*a*, 23*b* is then formed with a material having good electrical conductivity such as aluminum so as to have a predetermined thickness.

Figure 7:
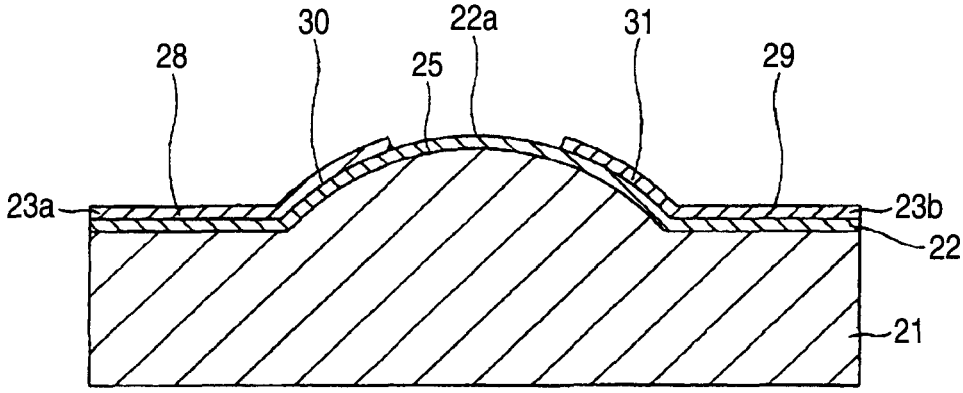
FIG. 7 is a cross-sectional view showing a condition in which a heat generating resistor and a pair of electrodes are provided on the glass layer.

Subsequently, as shown in FIG. 7, the pair of electrodes 23*a*, 23*b* are patterned so that the width of the end sections 28, 29 on the opposed side to the side of the heat generating resistor 22 and the heat generating section 22*a* is smaller than the width of the end sections 30, 31 on the side of the heat generating section 22*a* with a good electrical conductivity using a pattern forming technology such as a photolithography process. The glass layer 21 is exposed in the portion where either the heat generating resistors 22 or the pair of electrodes 23*a*, 23*b* are not formed.

Figure 8:
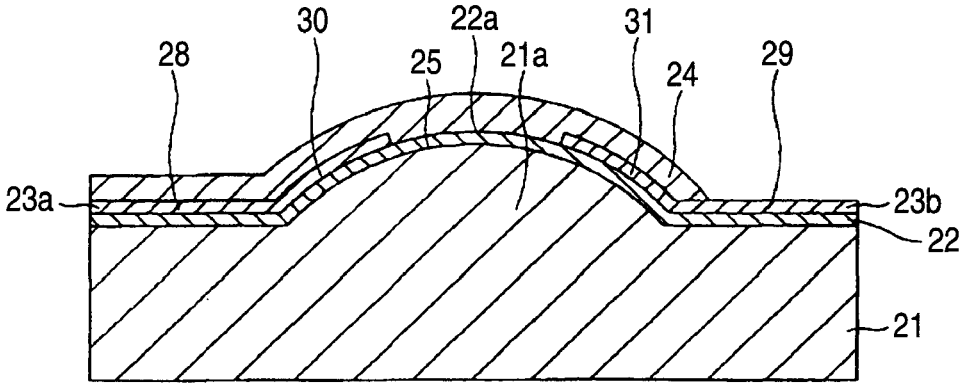
FIG. 8 is a cross-sectional view showing a condition in which a resistor protective layer is provided on the heat generating resistor and the pair of electrodes.
Figure 9:
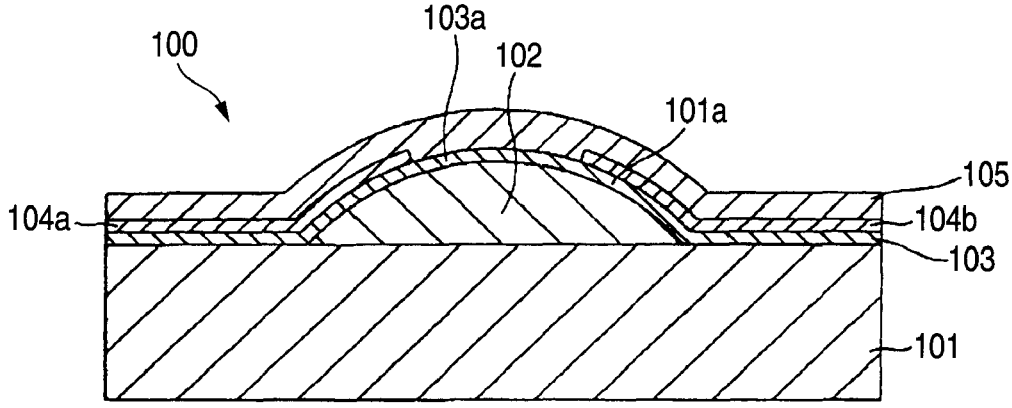
FIG. 9 is a cross-sectional view of a thermal head in the related art.
Figure 10:
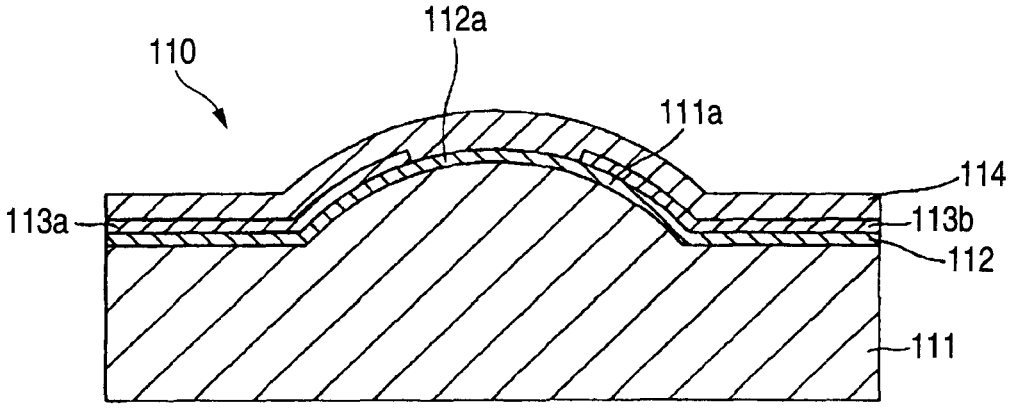
FIG. 10 is a cross-sectional view of the thermal head explained as the related art of the invention.
Figure 11:
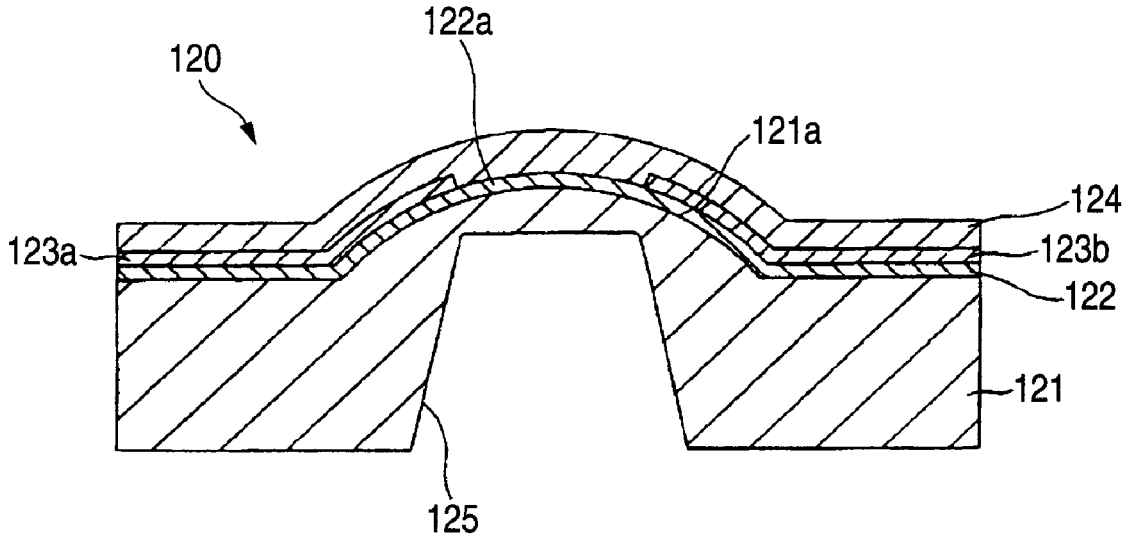
FIG. 11 is a cross-sectional view of the thermal head explained as the related art of the invention.

Subsequently, as shown in FIG. 8, the resistor protective layer 24 is formed on the heat generating section 22*a* and the pair of electrodes 23*a*, 23*b* with a predetermined thickness using a thin film forming technology such as a sputtering process. It should be noted that in this case, the resistor protective layer 24 is formed so that the portions of the individual electrodes 23*b* electrically connected to the signal flexible board 15 are exposed.

Subsequently, as shown in FIG. 3, the concave groove section 26 is formed on the surface opposed to the surface of the glass layer 21 provided with the protruding section 25, namely the surface to be the inside surface of the thermal head 2 by an etching process or a cutting process, thus forming the head section 11.

It should be noted that after forming the groove section 26 by the cutting process, a hydrofluoric acid treatment can be performed on the inside surface of the groove section 26 in order for remove scratches caused on the inside surface of the groove section 26. Further, the groove section 26 can be formed by an etching process or a thermal press process besides the machining process such as the cutting process.

The head section 11 thus manufactured as described above is bonded with the heat radiation member 12 as shown in FIG. 2. The heat radiation member 12 is made of a material having high thermal conductivity such as aluminum. The head section 11 is provided with the heat radiation member 12 bonded to the inside surface of the glass layer 21, to which the groove section 26 is provided, with a thermally conductive adhesive or the like.

The rigid board 13 is provided with a plurality of electronic components, and is provided with the control circuit for controlling driving of the heat generating section 22*a* of the head section 11 and wiring electrically connected to the power source not shown. The rigid board 13 is connected to the common electrode 23*a* of the head section 11 at the wiring via the power supply flexible board 14, and as shown in FIG. 4, the individual electrodes 23*b* of the head section 11 are electrically connected to the control circuit via connection terminals 15*a* of the signal flexible board 15. The rigid board 13 is disposed on the side surface of the heat radiation member 12 while bending the power supply flexible board 14 and the signal flexible board 15 towards the heat radiation member side, and is fixed with fixing members 16 such as screws. Thus, the thermal head 2 can be downsized.

In the head section 11 as described above, the common electrode 23*a* is supplied with the electrical current from the power supply as shown in FIG. 4, and the control circuit provided on the rigid board 13 controls on/off of the switches not shown and connected to the respective individual electrodes 23*b* to control the electrical currents to be applied to the heat generating sections 22*a*, thus making the heat generating sections 22*a* generate heat.

Since in the head section 11 the widths of the end sections 28, 29 of the pair of electrodes 23*a*, 23*b* on the opposite side to the side of the heat generating section 22*a* are narrower than the widths of the end sections 30, 31 thereof on the side of the heat generating section 22*a*, the thermal resistances of the pair of electrodes 23*a*, 23*b* are increased, thus preventing the thermal energy generated by the heat generating section 22*a* from being radiated to the outside, the power supply flexible board 14, and the signal flexible board 15 via the electrodes 23*a*, 23*b*. Further, since the groove section 26 is provided to the glass layer 21, the head section 11 can also prevent the heat radiation to the glass layer 21. According to the above, the heat amount for thermal-transferring the color materials on the ink ribbon 3 does not reduce in the head section 11, thus the thermal effective can be made preferable. Further, in the thermal head 11, since the thickness of the glass layer 21 becomes smaller to reduce the heat storage capacity by providing the groove section 26 to the glass layer 21, the heat radiation is enhanced, thus the response becomes also preferable. According to the above, since the thermal efficiency and the response are improved in the thermal head 2 equipped with the head section 11, high quality images and characters can be printed at high speed.

It should be noted that although the thermal head 2 is explained exemplifying the case of printing postcards with the home-use printing device 1, the thermal head 2 can be applied not only to the home-use printing device 1 but also to a business-use printing device. Further, the size of the printing medium is not particularly limited, and the thermal head 2 can also be applied to L-size photo paper or plain paper in addition to the postcards, thus high quality images and characters can be printed at high speed.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal head comprising:
- a glass layer having a top side and a backside;
- a groove section in the backside of the glass layer;
- a heat generating resistor disposed on the top side of the glass layer and extending along the top side of the glass layer in a first direction;
- a pair of electrodes on respective ends of the heat generating resistor; and
- a common electrode section;
- wherein,
  - a part of the heat generating resistor is exposed between the pair of electrodes and serves as a heat generating section, and
  - at least one of the pair of electrodes has (a) first section extending toward the heat generating section and (b) a second section extending from the first section to the common electrode section, the second section extending away from the heat generating section, the first section having a width in a second direction perpendicular to the first direction that is larger than a width of the second section in the second direction.

2. The thermal head according to claim 1 wherein the width of the first section of the electrode is substantially the same as a width of the heat generating section.

3. The thermal head according to claim 1 wherein one of the pair of electrodes is an extension of the common electrode section which is common to a plurality of heat generating sections.

4. The thermal head according to claim 1 wherein at least the first section of the electrode is on the heat generating resistor.

5. A printing device comprising a thermal head, said thermal head including:
- a glass layer having a top side and a back side;
- a groove in the back side;
- a heat generating resistor on the top side of the glass layer and extending along the top side in a first direction;
- a pair of electrodes on respective ends of the heat generating resistor; and
- a common electrode section,
- wherein,
  - a part of the heat generating resistor is exposed between the pair of electrodes and serves as a heat generating section, and
  - at least one of the pair of electrodes has (a) a first section extending toward the heat generating section and (b) a second section extending from the first section to the common electrode section, the second section extending away from the heat generating section, the first section having a width in a second direction perpendicular to the first direction that is larger than a width of the second section in the second direction.

6. The printing device according to claim 5,
- wherein the width of the first section of the electrode is substantially the same as a width of the heat generating section.

7. The printing device according to claim 5,
- wherein one of the pair of electrodes is an extension of the common electrode section which is common to a plurality of heat generating sections.

8. The printing device according to claim 5,
- wherein the first section of the electrode is at least on the heat generating resistor.

* * * * *